US006224428B1

(12) United States Patent
Chen et al.

(10) Patent No.: US 6,224,428 B1
(45) Date of Patent: May 1, 2001

(54) ELECTRICAL CONNECTOR AND METHOD OF ASSEMBLING AND CONNECTING THE SAME WITH CIRCUIT DEVICES

(75) Inventors: Ping Chen; Kimihiro Miyake, both of Aichi (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/402,551

(22) PCT Filed: Apr. 7, 1998

(86) PCT No.: PCT/US98/06972

§ 371 Date: Oct. 6, 1999

§ 102(e) Date: Oct. 6, 1999

(87) PCT Pub. No.: WO98/45909

PCT Pub. Date: Oct. 15, 1998

(30) Foreign Application Priority Data

Apr. 9, 1997 (JP) ..... 9-106711

(51) Int. Cl.[7] ..... H01R 13/04

(52) U.S. Cl. ..... 439/694; 439/188; 439/699.2; 439/918

(58) Field of Search ..... 439/694, 699.2, 439/918, 356, 558, 336, 619, 731, 696, 36, 465, 466, 188

(56) References Cited

U.S. PATENT DOCUMENTS

| | | | | |
|---|---|---|---|---|
| 4,225,205 | * | 9/1980 | Sinclair et al. | 439/467 |
| 4,804,343 | * | 2/1989 | Reedy | 439/699.2 |
| 5,456,620 | * | 10/1995 | Kaminski | 439/619 |
| 5,823,806 | * | 10/1998 | Nagase et al. | 439/336 |
| 5,871,377 | * | 2/1999 | Sato et al. | 439/918 |

FOREIGN PATENT DOCUMENTS 5-68088 9/1993 (JP) .

* cited by examiner

*Primary Examiner*—Paula Bradley
*Assistant Examiner*—Tho D. Ta

(57) ABSTRACT

The present invention provides an electrical connector which is connected to wires extending from a circuit device, and which makes it possible to realize high contact reliability with mating members, and a method of assembling and connecting the electrical connector with circuit devices. Electrical wires are terminated at one end to male first terminals, the opposite ends of the wires are connected to a circuit device, and the lead out portions of the wires from the circuit device are subjected to a potting treatment. Afterward, the first terminals are accommodated inside the first housing member. The first terminals are placed in positions so as to be engaged with second terminals that have been accommodated inside the first housing member before hand. A second housing member is latched onto the first housing member and provides terminal support for the first terminals and strain relief for the electrical wires.

14 Claims, 6 Drawing Sheets

ELECTRICAL CONNECTOR AND METHOD OF ASSEMBLING AND CONNECTING THE SAME WITH CIRCUIT DEVICES

FIELD OF THE INVENTION

The present invention relates to an electrical connector, especially an electrical connector which accommodates electrical terminals that are connected to wires extending from a circuit device, and a method of assembling and connecting the electrical connector with the circuit device.

BACKGROUND OF THE INVENTION

In recent years, discharge lamps have begun to be used as head lamps in automobiles. Like conventional lamps, such discharge lamps are accommodated in a socket connector and electrically connected with electrical terminals inside the housing of the socket connector. One example of such a socket connector is disclosed in Japanese Utility Model Application No. 5-68088. When the use of lamps of this type is considered, one important point to keep in mind is that a high voltage of approximately 20,000 V is required in order to initiate the discharge of the lamp when the lamp is switched on. Accordingly, the wires which are connected to the electrical terminals of the socket connector are connected to an electrical circuit device which includes a transformer and electrical wires that lead out from the circuit device.

It is necessary to consider the following two points in order to realize electrical wiring which connects such a socket connector and circuit device. First of all, the socket connector requires electrical terminals which include female contact sections that are connected to the discharge lamp. Secondly, the electrical circuit device, including the electrical wires, must be subjected to a potting treatment by means of a resin. The latter treatment is performed in order to insure the safety of the circuit, acts to prevent unintentional discharge and provides waterproofing.

However, it is difficult to increase the reliability of the connection with the discharge lamp while satisfying both of the requirements described above. The reason for this is that the electrical terminals that terminate the wires are heated to a temperature of approximately 200 degrees in the process of the potting treatment, so that there is a danger that the spring characteristics of the female contact sections will decrease.

SUMMARY OF THE INVENTION

Accordingly, a feature of the present invention is to provide an electrical connector which satisfies the above requirements in terms of structure and process, and which at the same times makes it possible to realize a high electrical connection reliability. In particular, the present invention provides an electrical connector which is suitable for mounting at the electrical terminal positions of electrical wires extending from a circuit device which requires a heat treatment process as in the case of the lamp socket described above, and a method of assembling the electrical connector with circuit devices.

The present invention is directed to an electrical connector in which electrical terminals terminating a plurality of electrical wires extending from a circuit device are accommodated in a housing and arranged so that engagement with a mating electrical terminal is possible, the terminals include male first terminals which respectively terminate the plurality of wires, and second terminals which are equipped with female contact sections capable of mating with the first terminals, and which are accommodated beforehand in the housing.

The housing has a terminal-supporting structure which supports the first terminals that mate with the second terminals. In this case, the housing is equipped with a wire-supporting structure which supports the wires that are terminated to the first terminals.

The housing has a two housing member structure and is constructed so that the first terminals and the wires terminated thereto are clamped between the two housing members.

Furthermore, the present invention also provides a method of assembling and connecting an electrical connector with circuit devices wherein the method comprises a process in which male first terminals are respectively connected to one end of each of a plurality of wires, the opposite ends of the plurality of wires are connected to a circuit device, second terminals provided with female contact sections that mate with the male terminals are installed in a first housing member which includes an engaging section that engages with a component, and the first terminals are installed in prescribed positions in the first housing member which allow mating with the second terminals.

The step in which the opposite ends of the wires are connected to the circuit device includes a potting treatment performed in the vicinity of the lead-out portions of the wires following the connection of the wires.

A second housing member is engaged with the first housing member wherein the second terminals are installed in the first housing member. In this case, the second housing member provides strain relief means for the terminal-supporting structure and the wire-supporting structure.

An electrical connector comprises a dielectric housing having electrical terminals terminated to electrical wires secured in the housing and arranged for electrical connection to an electrical component, wherein the electrical terminals include first electrical terminals and second electrical terminals, the first electrical terminals are respectively terminated to ends of the electrical wires, the first electrical terminals have contact sections electrically engageable with contact members of the second electrical terminals.

BRIEF DESCRIPTION OF THE DRAWINGS

An embodiment of the present invention will now be described by way of example with reference to the accompanying drawings in which:

FIGS. 4*a*–4*c* show a second terminal with FIGS. 4*a* and 4*b* being perspective views from different directions, while FIG. 4*c* is a cross-sectional view.

DETAILED DESCRIPTION OF THE PREFERRED EMBODIMENT

Figure 1:
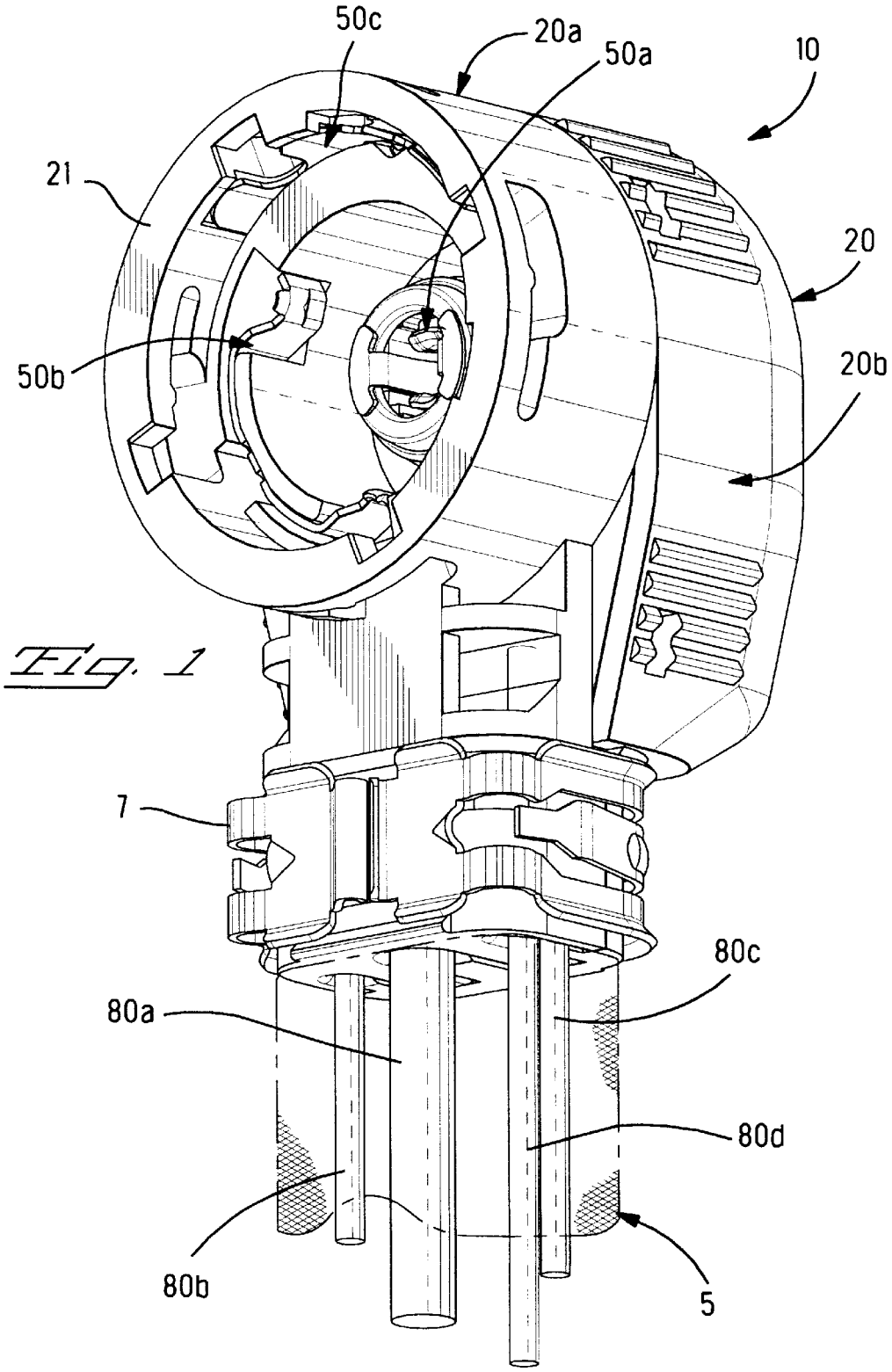
FIG. 1 is a perspective view showing an electrical connector of the present invention.

FIG. 1 shows an electrical connector 10 of the present invention. Electrical connector 10 is a socket connector for a discharge lamp used for automobiles. Housing 20 of the electrical connector 10 is made from a suitable dielectric material and has a lamp-receiving section 21, which has a roughly circular outer diameter for receiving a discharge lamp. Two female electrical terminals 50*a*, 50*b* which electrically engage a pair of electrodes of the lamp are contained inside lamp-receiving section 21. Furthermore, an electrical terminal 50*c* for engagement detection having a metal late is installed in the housing 20. Electrical wires 80*a*, 80*b* extending downward from the housing 20 are electrically connected to the respective terminals 50*a*, 50*b*. As may be seen by comparing the diameters of wires 80*a*, 80*b*, wire 80*a* is used for the high-voltage side, and wire 80*b* is used for the low-voltage side. The other electrical wires 80*c*, 80*d* are constructed so that these wires can be electrically connected with the terminal 50*c* which constitutes an engagement detection member. Details of this structure will be described later. Furthermore, the wires 80*a*–80*d* are part of a shielded cable, with a shielding conductor 5 being disposed around the four wires 80*a*–80*d*.

Housing 20 comprises a first housing member 20*a*, which includes the lamp-receiving section 21, and a second housing member 20*b*, which is positioned on a back surface of the first housing member 20*a*. As will be described later, the wires 80*a*–80*d*, which extend along an interior of the housing 20 are positioned therein by being clamped between the two housing members 20*a*, 20*b*.

The structure of the electrical connector 10 and a method to assemble the electrical connector 10 will be described below. In this way, the effect and merit of the present invention will be clarified.

Figure 2:
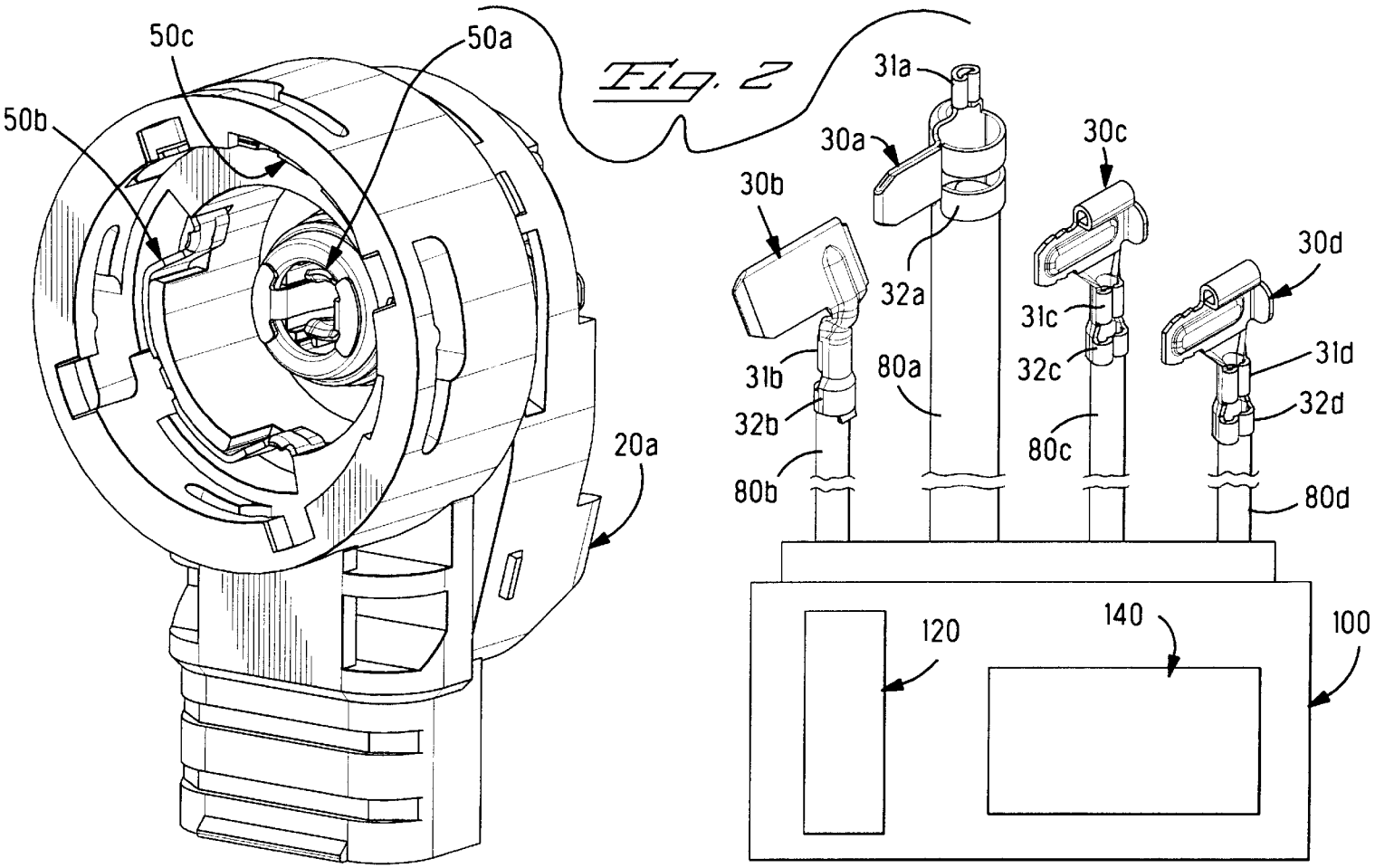
FIG. 2 is an exploded perspective view showing a first housing member, first electrical terminals terminated to respective electrical wires and a circuit device to which the electrical wires are electrically connected.

As shown in FIG. 2, the plurality of electrical terminals used in the electrical connector of the present invention includes a total of seven terminals; four of these terminals are first terminals 30*a*–30*d* which are used to terminate the respective wires 80*a*–80*d*, while the remaining three terminals are second terminals 50*a*–50*c* which are supported in the first housing member 20*a*. The first terminals 30*a*–30*d* are all crimped terminals. Specifically, the respective first terminals 30*a*–30*d* are constructed so that these terminals can be electrically connected to the wires 80*a*–80*d* by conventional crimping; these terminals have conductor-crimping sections 31*a*–31*d*, which are crimped to the electrical conductors of the wires 80*a*–80*d*, and insulation-crimping sections 32*a*–32*d*, which are crimped to the insulating coverings of the wires 80*a*–80*d*.

Figure 3A:
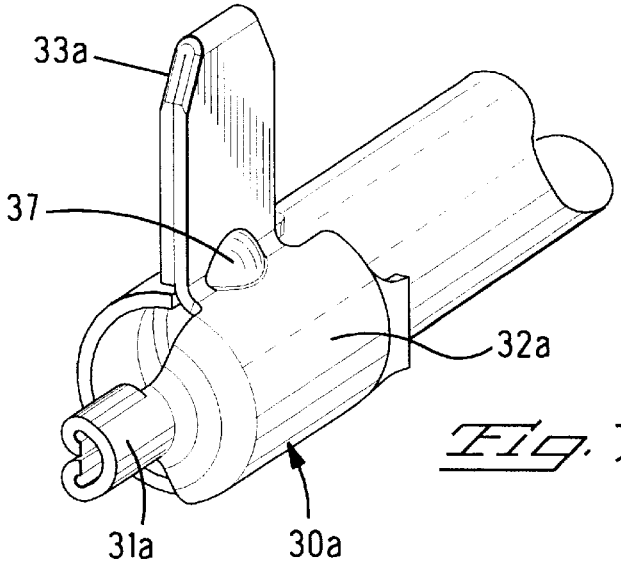
FIGS. 3*a*–3*c* are perspective views of the respective first terminals shown in FIG. 2 with FIG. 3*a* showing a high-voltage terminal, FIG. 3*b* showing a low-voltage terminal, and FIG. 3*c* showing a terminal used for engagement detection.
Figure 3B:
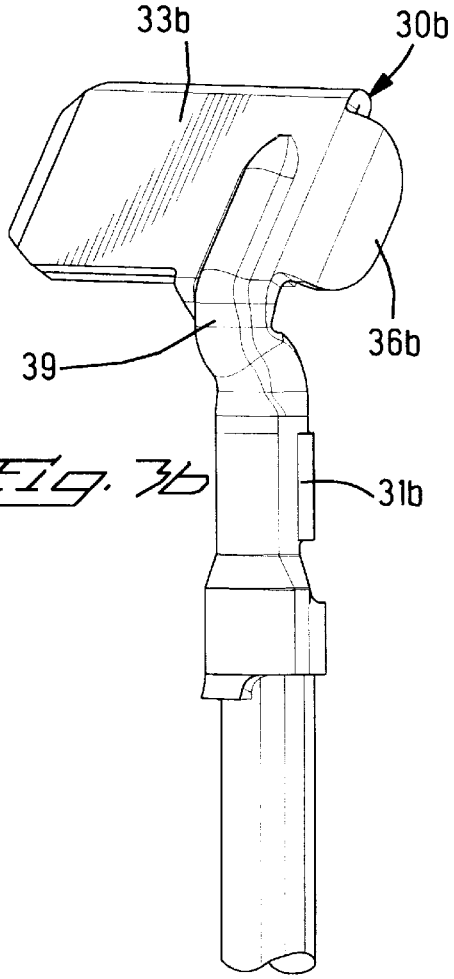
Figure 3C:
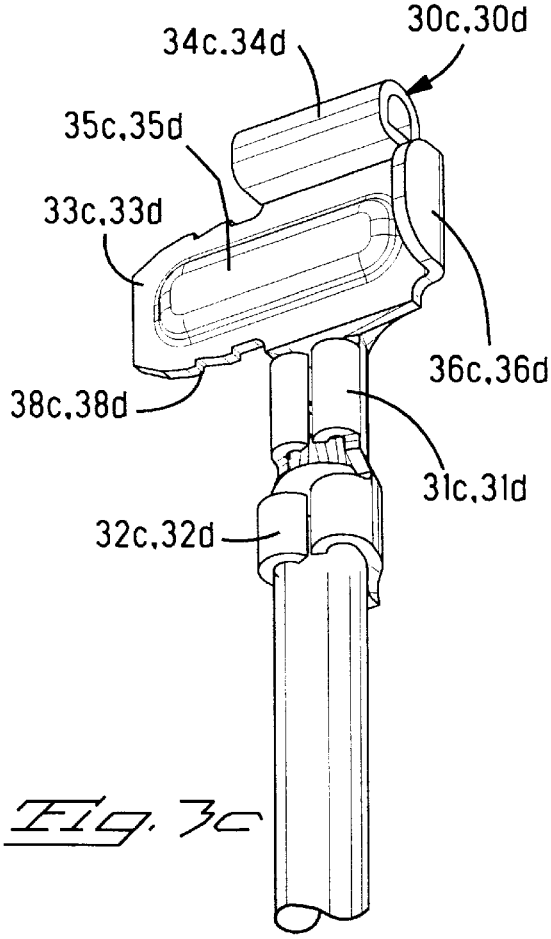

FIGS. 3*a*–3*c* are perspective views of the respective first terminals.

As shown in FIG. 2 and FIG. 3*a*, the first terminal 30*a*, which is crimped to the relatively large-diameter wire 80*a* to which a high voltage is applied, is constructed so that a tab section 33*a*, which operates as a contact section with a mating terminal, extends at a right angle from the insulation-crimping section 32*a*. A reinforcing projection 37 is located at the root portion of the tab section 33*a*. Furthermore, as shown in FIG. 2 and FIG. 3*b*, the first terminal 30*b* has a tab section 33*b* which extends at a right angle from a point located toward an end of the conductor-crimping section 31*b*. Tab section 33*b*, which operates as a contact section with a mating terminal, includes two metal plates which are folded and superimposed by bending a metal plate 180 degrees; furthermore, tab section 33*b* is inclined by an angle of approximately 30 degrees with respect to an axis of the terminal 30*b*. A bead 39 is formed in order to reinforce the inclined tab section 33*b*. Furthermore, a rear tab 36*b*, which is bent and extended substantially at a right angle with respect to the tab section 33*b*, is located at an opposite end of the tab section 33*b* from an engaging end thereof.

As shown in FIG. 2 and FIG. 3*c*, the first terminals 30*c*, 30*d* are terminals which have the same shape and dimensions; these terminals both have tab sections 33*c*, 33*d* which extend at a right angle with respect to the respective conductor-crimping sections 31*c*, 31*d*. However, terminals 30*c*, 30*d* differ from the other first terminals 30*a*, 30*b* in that tab surfaces of the tab sections 33*c*, 33*d* are not used for engagement with mating terminals. The tab sections 33*c*, 33*d* are not inclined like the tab section 33*b* of the first terminal 30*b*, but rather extend in substantially the same plane as the conductor-crimping sections 31*c*, 31*d* and the insulation-crimping sections 32*c*, 32*d*. Projections 35*c*, 35*d* are located on the tab sections 33*c*, 33*e* within this plane. Furthermore, rear tabs 36*c*, 36*d* similar to the rear tab 36*b* of the first terminal 30*b* are located at the rear ends of the tab sections 33*c*, 33*d*. Moreover, press-fitting projections 38*c*, 38*d* are located on the edges of the tab sections 33*c*, 33*d*. Furthermore, respective cylindrical contact sections 34*c*, 34*d*, which are formed by bending a metal plate into the form of a cylinder , are located on one edge of each of the tab sections 33*c*, 33*d*, i.e., on the opposite edge from the conductor-crimping sections 31*c*, 31*d*. Thus, it should be noted that the contact sections of all of the first terminals 30*a*–30*d* mate with the mating terminals, i.e., the tab sections 33*a*, 33*b* and contact sections 34*c*, 34*d* are formed as male contacts which have no resiliency.

The terminals 50*a*, 50*b*, 50*c*, which constitute the second terminals within the first housing member 20*a* shown in FIGS. 1, 2, are accommodated inside the first housing member 20*a* beforehand, prior to having any engaged relationship with the first terminals 30*a*, 30*d*.

Figure 4A:
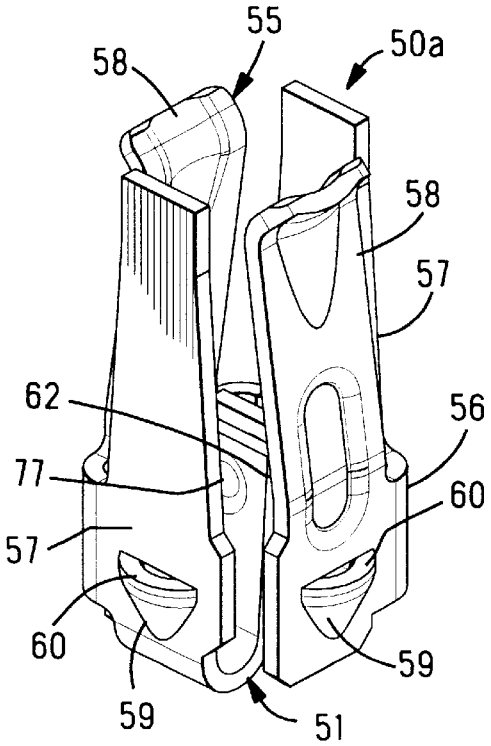
Figure 4B:
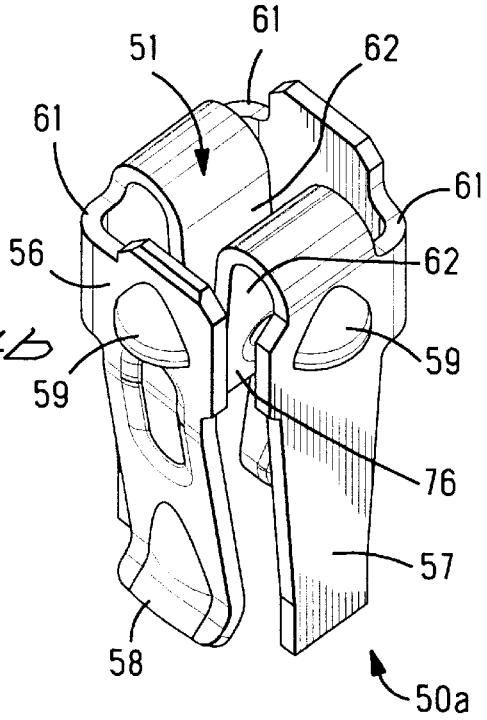
Figure 4C:
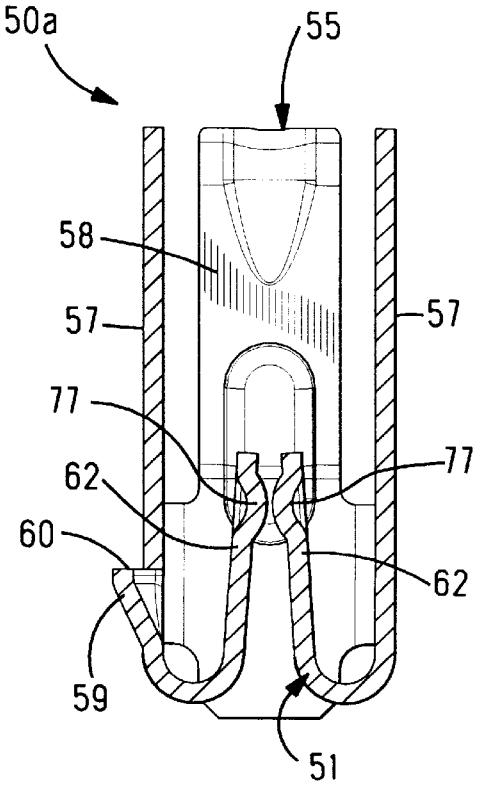
Figure 5:
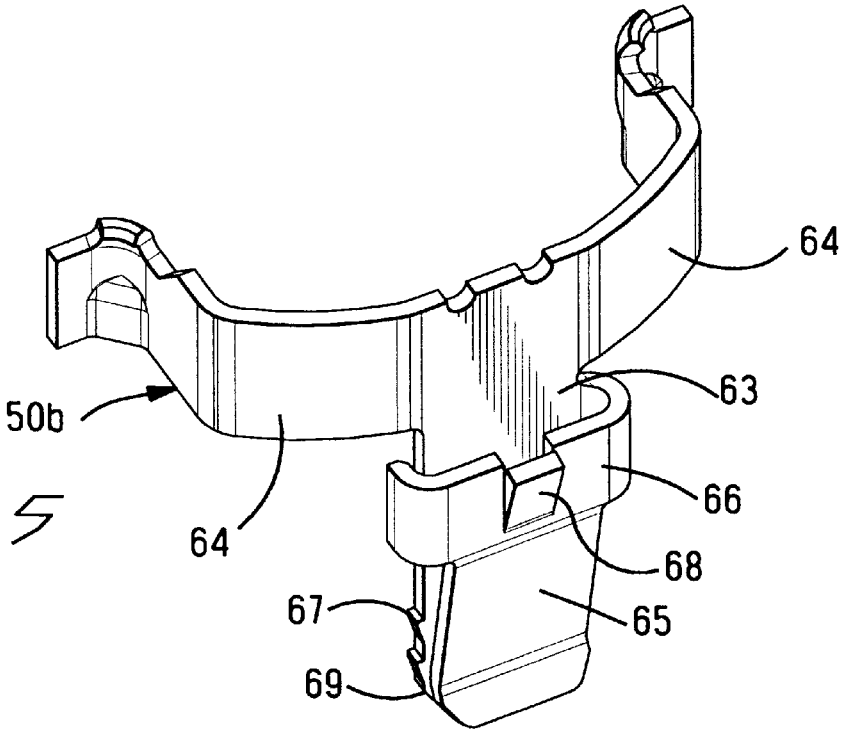
FIG. 5 is a perspective view of another second terminal.

FIGS. 4*a*–4*c* show a second terminal 50*a* and FIG. 5 shows a second terminal 50*b*. The second terminals 50*a*, 50*b* are accommodated in the first housing member 20*a*. The second terminal 50*c* will be described later.

As shown in FIGS. 4*a*–4*c*, the second terminal 50*a* is constructed by folding a metal plate so that the overall external shape of the terminal is substantially a long, slender box shape. A female contact portion 51, which engages with the first terminal 30*a*, is formed in one end of the second terminal 50*a* with respect to the direction of length, and a female contact portion 55, which engages one of the electrodes of the discharge lamp that is to be connected with the electrical connector 10, is located at the opposite end of the second terminal 50*a*. The substantially box-shaped portion comprises a base portion 56, a pair of walls 57, which extend from the base portion 56 so that the walls face each other, and a pair of resilient contact members 58, which also extend from the base portion 56, and which face each other at right angles to the walls 57 so that contact members 58 constitute the female contact portion 55. The resilient contact members 58 are formed so that they are bent slightly inward. Projections 59 are located on the surfaces of two of the plates constituting the base portion 56. The projections 59 include shoulders 60 which engage with inside walls of a cavity when the terminal 50*a* is inserted into the first housing member 20*a*, and which thus prevent the terminal

50*a* from slipping out in one direction. Furthermore, as shown in FIG. 4*b,* shoulders 61, which similarly engage with the inside walls of the cavity and thus prevent the terminals 50*a* from slipping out in the opposite direction, are also formed at three places on the corners of the bottom end of the base portion 56. A space 76 is located at the remaining corner. In conjunction with the cavity (not shown), the space 76 acts to engage a key in the cavity, which determines the direction and angle of insertion of the terminal 50*a* into the cavity. Furthermore, as will be seen from FIGS. 4*b,* 4*c,* the female contact portion 51 is constructed from a pair of resilient contact members 62, which extend from the ends of the opposite walls 57 at the bottom end of the base portion 56 and which are further bent into a U-shape when folded back in the opposite direction. Projections 77, which act as contact points, are formed on the respective contact members 62.

As shown in FIG. 5, the second terminal 50*b* is formed by the folding of a metal plate, and it has a base member 63 extending in the direction of height, a pair of resilient contact members 64 extending in both lateral directions from one end of the base member 63, and a folded-back member 66, which is formed by being folded back from one edge of the base member 63 and which is equipped with a contact member 65 that is capable of receiving and clamping a mating male terminal between itself and the base member 63. Specifically, the female contact section 69, which electrically engages with the first terminal 30*b,* is formed by the base member 63 and contact member 65. The resilient contact members 64 are used for electrical engagement with the electrodes of the discharge lamp. When the second terminal 50*b* is inserted into the corresponding cavity of the first housing member 20*a,* the second terminal 50*b* is held inside the first housing member 20*a* by the frictional engagement of the press-fitting projections 67 formed on edges of base member 63 with walls of the cavity, and the engagement of the lance 68 formed on the contact member 65 with a shoulder in the cavity.

As shown in FIG. 2, the first terminals 30*a*–30*d* are connected to a circuit device 100 via the wires 80*a*–80*d*. The wires 80*a*–80*d* extend from the same circuit device 100. The circuit device 100 includes a circuit board 140 such as an epoxy circuit board on which a transformer 120 and other circuit parts are mounted so that the necessary high voltage can be provided to light the discharge lamp. In order to prevent discharge and provide waterproofing in the vicinity of the lead-out portions of the wires, the wires 80*a*–80*d* are subjected to a potting treatment including the lead-out portions of the wires. The electrical connector 10 of the present invention is constructed so that this potting treatment work can easily be performed. This work will be described below.

The construction shown in FIG. 2 may be described as follows in the order of assembly and connection. First, in a first step of a process of assembly and connection, crimping of the first terminals 30*a*–30*d* to the wires 80*a*–80*d* of the shielded cable is performed. Next, in a second step of the assembly process, connection of the wires 80*a*–80*d* to the circuit device, and a potting treatment which covers the lead-out portions of the wires, are performed. Since the crimping work is performed prior to the second step in which the wires 80*a*–80*d* are connected to the circuit device, the crimping work can be efficiently performed by means of automated machinery. Furthermore, independent of the first and second steps described above, the second terminals 50*a*–50*c* are accommodated inside the first housing member 20*a* as a third step in the process. The third step may be performed either before or after the first and second steps, however, it is desirable to perform the third step in advance prior to the completion of the second step. The shapes and means of fastening of the second terminals 50*a,* 50*b* are as described above. Furthermore, the second terminal 50*c,* which is used for engagement detection will not be described in detail; however, terminal 50*c* is installed so that it is free to slide inside the first housing member 20*a*.

Figure 6:
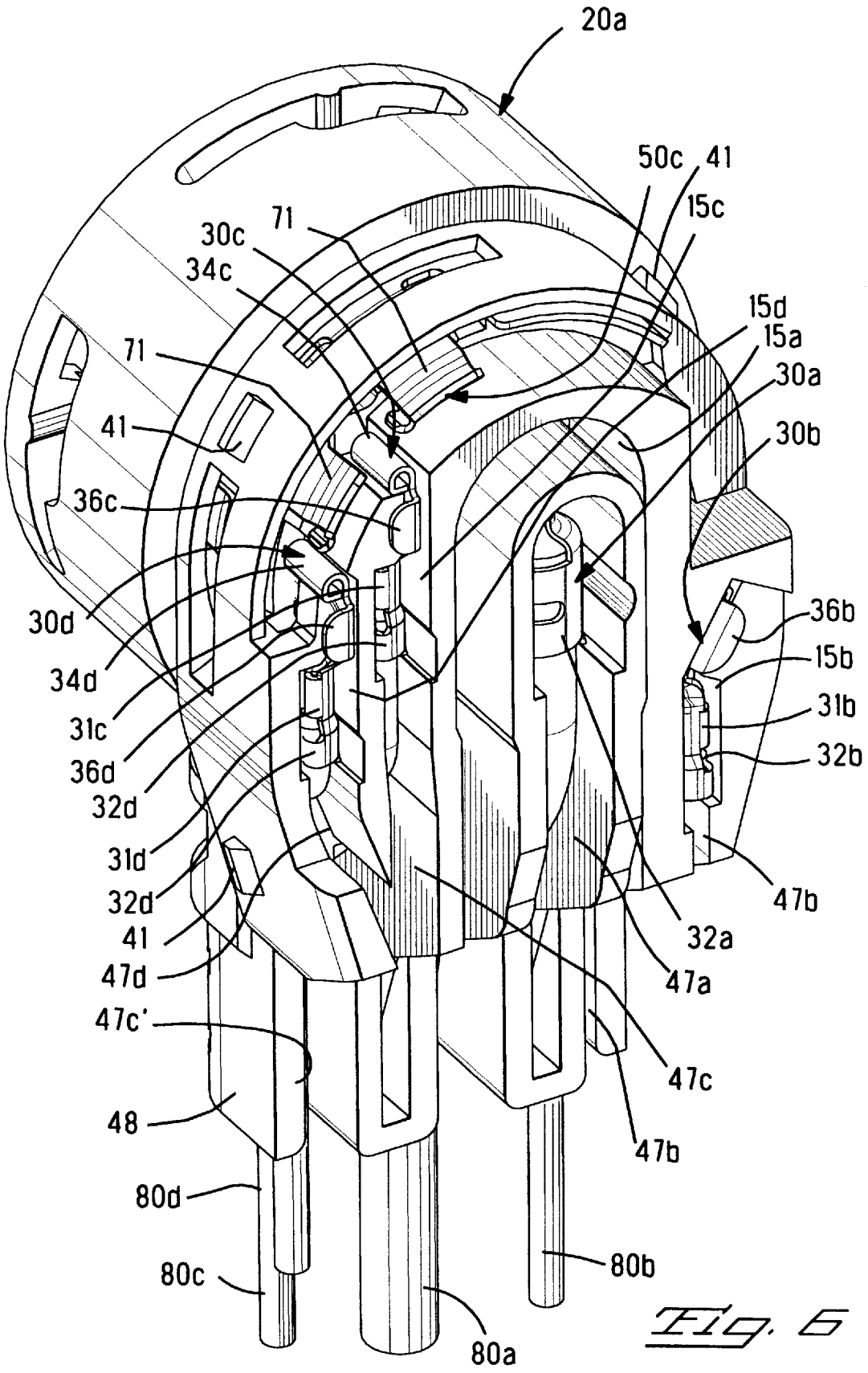
FIG. 6 is a perspective view showing the first terminals and the wires terminated thereto mounted in the first housing member.

The fourth step in the process of assembly and connection, which follows the first, second and third steps described above, will be described with reference to FIG. 6. FIG. 6 shows a state in which the first terminals terminating the wires are mounted in the first housing member.

In the fourth step of the process of assembly and connection of the electrical connector 10, the first terminals 30*a*–30*d* are accommodated in the first housing member 20*a*. As shown in FIG. 6, cavities 15*a*–15*d* for accommodating the respective terminals are formed in the first housing member 20*a*. When the first terminals 30*a,* 30*b* are accommodated in the cavities 15*a,* 15*b,* they are electrically connected with the second terminals 50*a,* 50*b* (not shown). As will be seen from both FIGS. 4, 5, the female contact portion 51 of the second terminal 50*a* engages with the tab section 33*a* of the first terminal 30*a,* and the female contact section 69 of the second terminals 50*b* engages with the tab section 33*b* of the first terminal 30*b*. (See FIGS. 3*a,* 3*b,* FIG. 4 and FIG. 5).

Even when the first terminals 30*c;* 30*d* are accommodated in the first housing member 20*a,* terminals 30*c,* 30*d* are ordinarily not in engagement with the second terminal 50*c*. As shown in FIG. 6, the second terminal 50*c,* which is used for engagement detection, has a pair of resilient contact members 71, which are arcuate plates extending along an outer circumference of the first housing member 20*a*. The resilient contact members 71 can be flexed in a direction substantially perpendicular to the plates of the contact members. Details of the action will not be described; however, the resilient contact members 71 of the second terminal 50*c* are constructed so that they electrically engage with the contact sections 34*c,* 34*d* of the first terminals 30*c,* 30*d* only when the electrical connector 10 is connected with the lamp. Second terminal 50*c* is slidable within first housing member 20*a* so that contact members 71 are electrically engaged with contact sections 34*c,* 34*d*.

Figure 7:
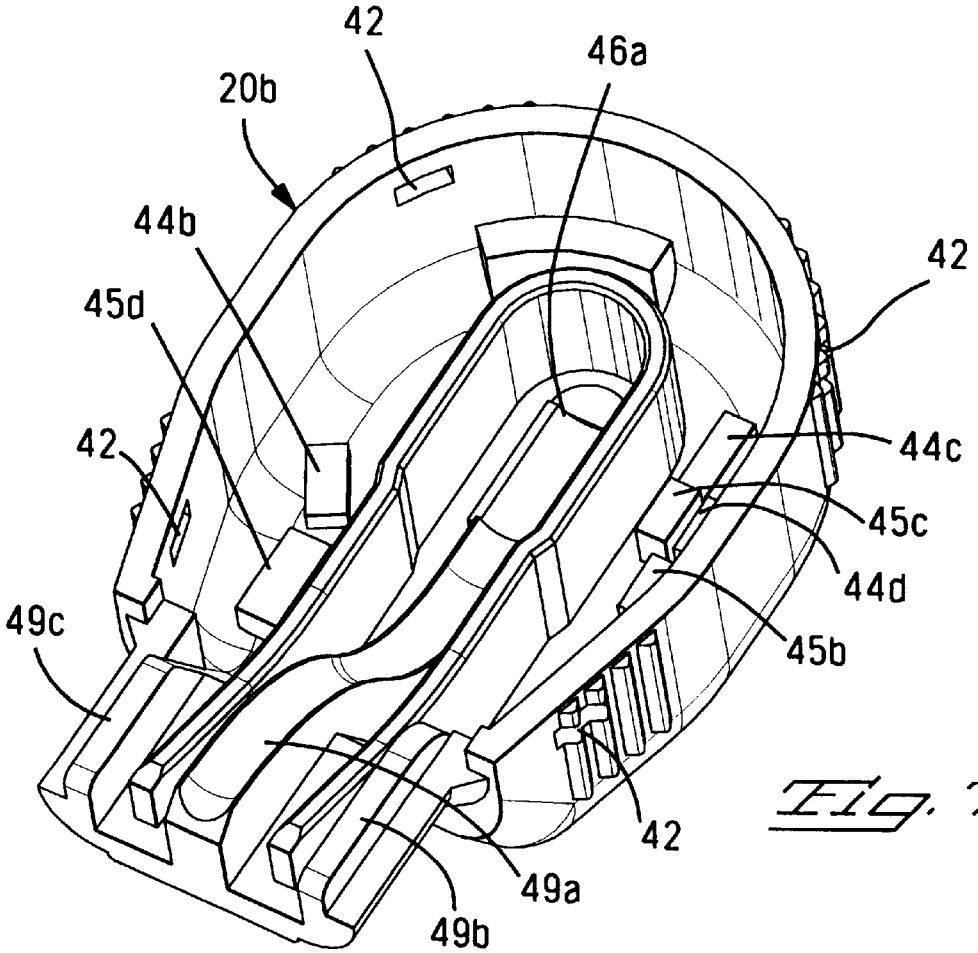
FIG. 7 is a perspective view of the second housing member which is to be mounted on a back surface of the first housing member.

In FIG. 7, the second housing member 20*b,* which is mounted on the back surface of the first housing member 20*a,* is shown in a perspective view. In the fifth step of the process of assembly, second housing member 20*b* is mounted on and latched with the first housing member 20*a,* As will be seen from FIGS. 6, 7, a plurality of spaced projections 41 are located along an outside surface of the first housing member 20*a*; furthermore, a plurality of spaced slots 42 are located along the second housing member 20*b,* and the first and second housing members 20*a,* 20*b* are fastened or latched together by the engagement of the projections 41 within slots 42. Referring again to FIG. 6, it can be seen that the first terminals 30*b,* 30*c,* 30*d* are installed so that the respective rear tabs 36*b,* 36*c,* and 36*d,* conductor-crimping sections 31*b,* 31*c,* 31*d* and insulation-crimping sections 32*b,* 32*c,* 32*d* face toward the rear. Furthermore, the first terminal 30*a* is installed so that the insulation-crimping section 32*a* faces toward the rear. A plurality of projections 44*b,* 44*c,* 44*d,* 45*b,* 45*c,* 45*d,* 46*a,* which are used to support the conductor-crimping sections and insulating-crimping sections are located in the second housing member 20*b*.

The projections 44*b,* 44*c,* 44*d* respectively support the rear tabs 36*b,* 36*c,* 36*d* of the first terminals 30*b,* 30*c,* 30*d,* and the projections 45*b,* 45*c,* 45*d* respectively support the conductor-crimping sections 31*b,* 31*c,* 31*d* or insulation-crimping sections 32*b,* 32*c,* 32*d* of the first terminals 30*b,* 30*c,* 30*d.* The projection 46*a* is used to support the insulation-crimping section 32*a* of the first terminal 30*a.* Furthermore, as will be seen by referring once again to FIG. 6, wire-accommodating grooves 47*a*–47*d,* which accommodate the wires 80*a*–80*d,* are located in the first housing member 20*a.* The wire-accommodating grooves 47*c,* 47*d* communicate with each other at an intermediate point, thus forming a single wire-accommodating groove 47*c′* in the wire lead-out area 48. The remaining wire-accommodating groove 47*b* extends independently to the wire lead-out area 48. When the first and second housing members 20*a,* 20*b* are engaged with each other, the wires 80*a*–80*d* are held inside the wire-accommodating grooves 47*a,* 47*b,* 47*c* in the wire lead-out area 48 by projections 49*a,* 49*b,* 49*c,* which are correspondingly located on the inside of the second housing member 20*b* so that the projections are disposed within the grooves. As a result, an effective strain relief structure is provided for the wires 80*a*–80*d.*

Afterward, the shielding conductor 5 of the shielded cable is terminated. The shielding conductor 5 may be fastened in place by means of a metal clip 7 as shown in FIG. 1; any of various conventional structures may be used.

An especially important point in the assembly process to construct the electrical connector of FIG. 1 is that the third step in the process can be performed independently of the first and second steps. As a result, it should be noted that the second terminals 50*a*–50*c* constructed in the third step in the process are not placed in a heated environment.

An electrical connector constituting an embodiment of the present invention, and a method of assembling the connector with a circuit device has been described above. However, this description is merely an example and does not limit the present invention in any way.

The electrical connector of the present invention comprises male first terminals which respectively terminate a plurality of wires, and second terminals which are equipped with female contact members capable of connecting with the first terminals, and which are accommodated beforehand in a housing. Accordingly, there is no danger of damage to the structural portions of the second terminals during handling or connection of the wires. In particular, even in cases where it is necessary to place the wires in a heated environment during the assembly and connection process, there is also no need to place the second terminals in this heated environment. Accordingly, there is no danger of heat-induced warping in the structural portions of the second terminals; consequently, the contact characteristics, and especially the contact pressure, can be insured.

What is claimed is:

1. An electrical connector for connecting a lamp to a component (100) through electrical wires (80*a*–80*d*) which extend between the connector and the component, the electrical connector comprising electrical terminals (30*a*–30*d*), (50*a*–50*c*) secured in a housing (20), the electrical connector being characterized in that the electrical terminals include a plurality of first electrical terminals (30*a*–30*d*) and a plurality of second electrical terminals (50*a*–50*c*), each of the first electrical terminals being respectively terminated to the ends of each of the electrical wires (80*a*–80*d*), the first electrical terminals (30*a*–30*d*) having contact sections (33*a,* 33*b,* 34*c,* 34*d*) electrically engaged with contact members (31, 56, 71) of the second electrical terminals (50*a*–50*c*), such that contact sections (34*c,* 34*d*) of two of said first electrical terminals (30*c,* 30*d*) are electrically connectable with said contact members (71) of one of said second electrical terminals (50*c*) when said electrical connector is connected with said lamp and the housing (20) including a first housing member (20*a*) attached to a second housing member (20*b*), the second housing member (20*b*) supporting the first terminals to secure the contact sections (33*a,* 33*b,* 34*c,* 34*d*) of the first terminals (30*a*–30*d*) in position for contact with the contact members (51, 56, 71) of the second terminals (50*a*–50*c*).

2. An electrical connector as claimed in claim 1, wherein one of the first terminals (30*a*) includes a tab section (33*a*) extending from a crimp section (32*a*) with the second housing member (20*b*) supporting the crimp section (32*a*) and the other first terminals (30*b*–30*d*) include right angle tabs (36*b*–36*d*) supported by the second housing member (20*b*).

3. An electrical connector as claimed in claim 2, wherein said first housing member (20*a*) accommodates said first electrical terminals (30*a*–30*d*) and said second electrical terminals (50*a*–50*c*).

4. An electrical connector as claimed in claim 3, wherein said first housing member (20*a*) has cavities (15*a*–15*d*) for accommodating said first electrical terminals (30*a*–30*d*) and wire-accommodating grooves (47*a*–47*c*) for accommodating the electrical wires (80*a*–80*d*) therein.

5. An electrical connector as claimed in claim 4, wherein when two of the first electrical terminals (30*a,* 30*b*) are accommodated in their respective cavities (15*a,* 15*b*), they are respectively electrically connected with two of said second electrical terminals (50*a,* 50*b*).

6. An electrical connector as claimed in claim 4, wherein said second housing member (20*b*) has first projections (44*b*–44*d,* 45*b*–45*d,* 46*a*) for engaging and supporting the first electrical terminals (30*a*–30*d*), and second projections (49*a*–49*c*) for disposition in said wire-accommodating grooves (47*a*–47*c*) and engaging the wires therein thereby providing strain relief.

7. An electrical connector as claimed in claim 6, wherein said first housing member (20*a*) and said second housing member (20*b*) have latch members (41, 42) for latching said first housing member and said second housing member together.

8. An electrical connector for connecting a lamp to a component through electrical wires, the electrical connector comprising:

a plurality of first electrical terminals, each being terminated to the end of a respective one of the electrical wires, the first electrical terminals and wires being positioned within wire accommodating grooves of a first housing member;

a plurality of second electrical terminals each having contact members extending into a second housing member, each of the contact members extending substantially perpendicular to the wire accommodating grooves to contact respective ones of the first electrical terminals;

whereby; two of said first electrical terminals are electrically connectable with said contact members of one of said second electrical terminals for engagement detection.

9. The electrical connector of claim 8 wherein said first housing member and said second housing member have latch members for latching said first housing member and said second housing member together.

10. The electrical connector of claim 8 wherein one of the first terminals includes a tab section extending from a crimp section with the second housing member supporting the crimp section and the other first terminals include right angle tabs supported by the second housing member.

11. The electrical connector of claim 10 wherein said first housing member accommodates said first electrical terminals and said second electrical terminals.

12. The electrical connector of claim 11 wherein said first housing member has cavities in communication with said wire accommodating grooves for accommodating said first electrical terminals.

13. The electrical connector of claim 8 wherein said second housing member has first projections for engaging and supporting said first electrical terminals.

14. The electrical connector of claim 13 wherein said second housing member has second projections for disposition in said wire accommodating grooves and for engaging the wires therein to provide stain relief.

* * * * *